US010155232B2

(12) United States Patent
Hartranft et al.

(10) Patent No.: US 10,155,232 B2
(45) **Date of Patent: *Dec. 18, 2018**

(54) CUP-SHAPED FLUIDIC CIRCUIT, NOZZLE ASSEMBLY AND METHOD

(71) Applicant: DLHBOWLES, INC., Canton, OH (US)

(72) Inventors: Evan Hartranft, Columbia, MD (US); Shridhar Gopalan, Westminster, MD (US); Gregory Russell, Catonsville, MD (US)

(73) Assignee: DLHBOWLES, INC., Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/819,384

(22) Filed: Nov. 21, 2017

(65) Prior Publication Data

US 2018/0071754 A1 Mar. 15, 2018

Related U.S. Application Data

(63) Continuation of application No. 13/816,661, filed as application No. PCT/US2012/034293 on Apr. 19, 2012, now Pat. No. 9,821,324.
(Continued)

(51) Int. Cl.
*B05B 1/08* (2006.01)
*B65D 83/28* (2006.01)
(Continued)

(52) U.S. Cl.
CPC ..... *B05B 1/08* (2013.01); *B65D 83/28* (2013.01); *B65D 83/753* (2013.01); *F15B 21/12* (2013.01); *Y10T 29/49826* (2015.01)

(58) Field of Classification Search
CPC ..... B05B 1/08; B65D 83/28; B65D 83/753; F15B 21/12; F15C 1/22
See application file for complete search history.

(56) References Cited

U.S. PATENT DOCUMENTS 3,608,832 A 9/1971 Hughes
4,036,439 A 7/1977 Green
(Continued)

OTHER PUBLICATIONS

International Searching Authority, U.S. Patent Office, International Search Report and Written Opinion for International App. No. PCT/US2012/034293 dated Sep. 7, 2012.

*Primary Examiner* — Ryan A Reis
(74) *Attorney, Agent, or Firm* — McDonald Hopkins LLC

(57) ABSTRACT

A conformal, cup-shaped fluidic nozzle engineered to generate an oscillating spray is configured as a (e.g., 100, 400, 600 or 700). Preferably, the fluidic circuit's oscillation inducing geometry 710 is molded directly into the cup's interior wall surfaces and the one-piece fluidic cup may then fitted into an actuator (e.g., 340). The fluidic cup (e.g., 100, 400, 600 or 700) conforms to the actuator stem used in typical aerosol sprayers and trigger sprayers and so replaces the prior art "swirl cup" 70 that goes over the actuator stem (e.g., 320), With the fluidic cup (e.g., 100, 400, 600 or 700) and method of the present invention, vendors of liquid products and fluids sold in commercial aerosol sprayers 20 and trigger sprayers 800 can now provide very specifically tailored or customized sprays.

14 Claims, 12 Drawing Sheets

Related U.S. Application Data

(60) Provisional application No. 61/476,845, filed on Apr. 19, 2011.

(51) Int. Cl.
*F15B 21/12* (2006.01)
*B65D 83/14* (2006.01)

(56) References Cited

U.S. PATENT DOCUMENTS

| | | | | |
|---|---|---|---|---|
| 4,349,153 | A | 9/1982 | Johnson | |
| 4,386,739 | A | 6/1983 | Kwok | |
| 5,114,052 | A | 5/1992 | Tiramani | |
| 5,161,716 | A | 11/1992 | Knickerbocker | |
| 5,718,383 | A | 2/1998 | Smith | |
| 5,820,034 | A | 10/1998 | Hess | |
| 5,845,845 | A | 12/1998 | Merke | |
| 5,878,959 | A | 3/1999 | Smolen | |
| 6,412,708 | B1 * | 7/2002 | Bohringer | A61H 33/027 239/407 |
| 6,793,156 | B2 * | 9/2004 | Dobbs | B05B 1/3436 239/343 |
| 6,817,493 | B1 | 11/2004 | Parsons | |
| 7,267,290 | B2 | 9/2007 | Gopalan | |
| 7,354,008 | B2 | 4/2008 | Hester | |
| 7,404,416 | B2 | 7/2008 | Schultz | |
| 7,472,848 | B2 | 1/2009 | Gopalan | |
| 7,478,764 | B2 | 1/2009 | Gopalan | |
| 7,780,098 | B2 | 8/2010 | Foster | |
| 7,926,741 | B2 * | 4/2011 | Laidler | B65D 83/44 222/402.1 |
| 8,322,631 | B2 | 12/2012 | Richardson | |
| D712,009 | S | 8/2014 | Gopalan | |
| 8,820,665 | B2 * | 9/2014 | Nelson | B05B 1/042 239/589 |
| 9,089,856 | B2 * | 7/2015 | Gopalan | B05B 1/08 |
| 2004/0195398 | A1 | 10/2004 | Mukai | |
| 2012/0037731 | A1 | 2/2012 | Cheng | |

* cited by examiner

CUP-SHAPED FLUIDIC CIRCUIT, NOZZLE ASSEMBLY AND METHOD

PRIORITY CLAIMS AND REFERENCE TO RELATED APPLICATIONS

This application is a continuation of U.S. Utility application Ser. No. 13/816,661 filed Apr. 1, 2013 entitled "CUP-SHAPED FLUIDIC CIRCUIT, NOZZLE ASSEMBLY AND METHOD," which is a National Stage Entry of International Application No. PCT/US12/34293 filed Apr. 19, 2012 "CUP-SHAPED FLUIDIC CIRCUIT, NOZZLE ASSEMBLY AND METHOD," which claims priority to related and commonly owned U.S. provisional patent application No. 61/476,845, filed Apr. 19, 2011 and entitled Method and Fluidic Cup apparatus for creating 2-D or 3-D spray patterns, the entire disclosure of which is incorporated herein by reference

BACKGROUND OF THE INVENTION

Field of the Invention

The present invention relates generally to nozzle assemblies adapted for use with transportable or disposable liquid product sprayers, and more particularly to such sprayers having nozzle assemblies configured for dispensing or generating sprays of selected fluids or liquid products is a desired spray pattern.

Discussion of the Prior Art

Cleaning fluids and other liquid products are often dispensed from disposable, pressurized or manually actuated sprayers which can generate a roughly conical spray pattern or a straight stream. Some dispensers or sprayers have an orifice cup with a discharge orifice through which product is dispensed or applied by sprayer actuation. For example, the manually actuated sprayer of U.S. Pat. No. 6,793,156 to Dobbs, et al illustrates an improved orifice cup mounted within the discharge passage of a manually actuated hand-held sprayer. The cup is held in place with its cylindrical side wall press fitted within the wall of a circular bore. Dobbs' orifice cup includes "spin mechanics" in the form of a spin chamber and spinning or tangential flows there are formed on the inner surface of the circular base wall of the orifice cup. Upon manual actuation of the sprayer, pressures are developed as the liquid product is forced through a constricted discharge passage and through the spin mechanics before issuing through the discharge orifice in the form of a traditional conical spray.

If no spin mechanics are provided or if the spin mechanics feature is immobilized, the liquid issues from the discharge orifice in the form of a stream. Typical orifice cups are molded with a cylindrical skirt wall, and an annular retention bead projects radially outwardly of the side of the cup near the front or distal end thereof. The orifice cup is typically force fitted within a cylindrical bore at the terminal end of a discharge passage in tight frictional engagement between the cylindrical side wall of the cup and the cylindrical bore wall. The annular retention bead is designed to project into the confronting cylindrical portion of the pump sprayer body serving to assist in retaining the orifice cup in place within the bore as well as in acting as a seal between the orifice cup and the bore of the discharge passage. The spin mechanics feature is formed on the inner surface of the base of the orifice cup to provide a swirl cup which functions to swirl the fluid or liquid product and break it up into a substantially conical spray pattern.

Manually pumped trigger sprayer of U.S. Pat. No. 5,114,052 to Tiramani, et al illustrates a trigger sprayer having a molded spray cap nozzle with radial slots or grooves which swirl the pressurized liquid to generate an atomized spray from the nozzle's orifice.

Other spray heads or nebulizing nozzles used in connection with disposable, manually actuated sprayers are incorporated into propellant pressurized packages including aerosol dispensers such as is described in U.S. Pat. No. 4,036,439 to Green and U.S. Pat. No. 7,926,741 to Laidler et al. All of these spray heads or nozzle assemblies include a swirl system or swirl chamber which work with a dispensing orifice via which the fluid is discharged from the dispenser member. The recesses, grooves or channels defining the swirl system co-operate with the nozzle to entrain the dispensed liquid or fluid in a swirling movement before it is discharged through the dispensing orifice. The swirl system is conventionally made up of one or more tangential swirl grooves, troughs, passages or channels opening out into a swirl chamber accurately centered on the dispensing orifice. The swirled, pressurized fluid is swirled and discharged through the dispensing orifice. U.S. Pat. No. 4,036,439 to Green describes a cup-shaped insert with a discharge orifice which fits over a projection having the grooves defined in the projection, so that the swirl cavity is defined between the projection and the cup-shaped insert.

All of these nozzle assembly or spray-head structures with swirl chambers are configured to generate substantially conical atomized or nebulized sprays of fluid or liquid in a continuous flow over the entire spray pattern, and droplet sizes are poorly controlled, often generating "fines" or nearly atomized droplets. Other spray patterns (e.g., a narrow oval which is nearly linear) are possible, but the control over the spray's pattern is limited. None of these prior art swirl chamber nozzles can generate an oscillating spray of liquid or provide precise sprayed droplet size control or spray pattern control. There are several consumer products packaged in aerosol sprayers and trigger sprayers where it is desirable to provide customized, precise liquid product spray patterns.

Oscillating fluidic sprays have many advantages over conventional, continuous sprays, and can be configured to generate an oscillating spray of liquid or provide a precise sprayed droplet size control or precisely customized spray pattern for a selected liquid or fluid. The applicants have been approached by liquid product makers who want to provide those advantages, but the prior art fluidic nozzle assemblies have not been configured for incorporation with disposable, manually actuated sprayers.

In applicants' durable and precise prior art fluidic circuit nozzle configurations, a fluidic nozzle is constructed by assembling a planar fluidic circuit or insert in to a weatherproof housing having a cavity that receives and aims the fluidic insert and seals the flow passage. A good example of a fluidic oscillator equipped nozzle assembly as used in the automotive industry is illustrated in commonly owned U.S. Pat. No. 7,267,290 (see, e.g., FIG. 3) which shows how the planar fluidic circuit insert is received within and aimed by the housing.

Fluidic circuit generated sprays could be very useful in disposable, manually actuated sprayers, but adapting the fluidic circuits and fluidic circuit nozzle assemblies of the prior art would cause additional engineering and manufacturing process changes to the currently available disposable, manually actuated sprayers, thus making them too expensive to produce at a commercially reasonable cost.

There is a need, therefore, for a commercially reasonable and inexpensive, disposable, manually actuated sprayer or nozzle assembly which provides the advantages of fluidic circuits and oscillating sprays, including precise sprayed droplet size control and precisely defined and controlled custom spray patterns for a selected liquid or fluid product.

OBJECTS AND SUMMARY OF THE INVENTION

Accordingly, it is an object of the present invention to overcome the above mentioned difficulties by providing a commercially reasonable inexpensive, disposable, manually actuated sprayer or nozzle assembly which provides the advantages of fluidic circuits and oscillating sprays, including precise sprayed droplet size control and precisely defined and controlled spray patterns selected liquid or fluid product.

In accordance with the present invention, a fluidic cup is preferably configured as a one-piece fluidic nozzle and does not require a multi-component insert and housing assembly. The fluidic oscillator's features or geometry are preferably molded directly into the cup which is then affixed to the actuator. This eliminates the need for an assembly made from a fluidic circuit defining insert which is received within a housing cavity. The present invention provides a novel fluidic circuit which functions like a planar fluidic circuit but which has the fluidic circuit's oscillation inducing features configured within a cup-shaped member.

The fluidic cup is useful with both hand-pumped trigger sprayers and propellant filled aerosol sprayers and can be configured to generate different sprays for different liquid or fluid products. Fluidic oscillator circuits are shown which can be configured to project a rectangular spray pattern (e.g., a 3-D or rectangular oscillating pattern of uniform droplets). The fluidic oscillator structure's fluid dynamic mechanism for generating the oscillation is conceptually similar to that shown and described in commonly owned U.S. Pat. Nos. 7,267,290 and 7,478,764 (Gopalan et al) which describe a planar mushroom fluidic circuit's operation; both of these patents are incorporated herein in their entireties.

In the exemplary embodiments illustrated herein, a mushroom-equivalent fluidic cup oscillator carries an annular retention bead which projects radially outwardly of the side of the cup near the front or distal end thereof. The fluidic cup is typically force fitted within an actuator's cylindrical bore at the terminal end of a discharge passage in tight frictional engagement between the cylindrical side wall of the cup and the cylindrical bore wall of the actuator. The annular retention bead is designed to project into a confronting cylindrical groove or trough retaining portion of the actuator or pump sprayer body serving to assist in retaining the fluidic cup in place within the bore as well as in acting as a seal between the fluidic cup and the bore of the discharge passage. The fluidic oscillator features or geometry are formed on the inner surtace(s) of the fluidic cup to provide a fluidic oscillator which functions to generate an oscillating pattern of droplets of uniform, selected size.

The novel fluidic circuit of the present invention is a conformal, one-piece, molded fluidic cup. There are several consumer applications like aerosol sprayers and trigger sprayers where it is desirable to customize sprays. Fluidic sprays are very useful in these cases but adapting typical commercial aerosol sprayers and trigger sprayers to accept the standard fluidic oscillator configurations would cause unreasonable product manufacturing process changes to current aerosol sprayers and trigger sprayers thus making them much more expensive. The fluidic cup and method of the present invention conforms to the actuator stem used in typical aerosol sprayers and trigger sprayers and so replaces the prior art "swirl cup" that goes over the actuator stem, and the benefits of using a fluidic oscillator are made available with little or no significant changes to other parts. With the fluidic cup and method of the present invention, vendors of liquid products and fluids sold in commercial aerosol sprayers and trigger sprayers can now provide very specifically tailored or customized sprays.

A nozzle assembly or spray head including a lumen or duct for dispensing or spraying a pressurized liquid product or fluid from a valve, pump or actuator assembly draws from a disposable or transportable container to generate an oscillating spray of very uniform fluid droplets. The fluidic cup nozzle assembly includes an actuator body having a distally projecting sealing post having a post peripheral wall terminating at a distal or outer face, and the actuator body includes a fluid passage communicating with the lumen.

A cup-shaped fluidic circuit is mounted in the actuator body member having a peripheral wall extending proximally into a bore in the actuator body radially outwardly of said sealing post and having a distal radial wall comprising an inner face opposing the sealing post's distal or outer face to define a fluid channel including a chamber having an interaction region between the body's sealing post and the cup-shaped fluidic circuit's peripheral wall and distal wall. The chamber is in fluid communication with the actuator body's fluid passage to define a fluidic circuit oscillator inlet so the pressurized fluid can enter the fluid channel's chamber and interaction region. The fluidic cup structure has a fluid inlet within the cup's proximally projecting cylindrical sidewall, and the exemplary fluid inlet is substantially annular and of constant cross section, but the fluidic cup's fluid inlet can also be tapered or include step discontinuities (e.g., with an abruptly smaller or stepped inside diameter) to enhance the pressurized fluid's instability.

The cup-shaped fluidic circuit distal wall's inner face either supports an insert with or carries the fluidic geometry, so it is configured to define the fluidic oscillator's operating features or geometry within the chamber. It should be emphasized that any fluidic oscillator geometry which defines an interaction region to generate an oscillating spray of fluid droplets can be used, but, for purposes of illustration, conformal cup-shaped fluidic oscillators having two exemplary fluidic oscillator geometries will be described in detail.

For a conformal cup-shaped fluidic oscillator embodiment which emulates the fluidic oscillation mechanisms of a planar mushroom fluidic oscillator circuit, the conformal fluidic cup's chamber includes a first power nozzle and second power nozzle, where the first power nozzle is configured to accelerate the movement of passing pressurized fluid flowing through the first nozzle to form a first jet of fluid flowing into the chamber's interaction region, and the second power nozzle is configured to accelerate the movement of passing pressurized fluid flowing through the second nozzle to form a second jet of fluid flowing into the chamber's interaction region. The first and second jets impinge upon one another at a selected inter-jet impingement angle (e.g., 180 degrees, meaning the jets impinge from opposite sides) and generate oscillating flow vortices within the fluid channel's interaction region which is in fluid communication with a discharge orifice or power nozzle defined in the fluidic circuit's distal wall, and the oscillating flow vortices spray droplets through the discharge orifice as an oscillating spray of substantially uniform fluid droplets in a selected (e.g., rectangular) spray pattern having a selected spray width and a selected spray thickness.

The first and second power nozzles are preferably venturi-shaped or tapered channels or grooves in the cup-shaped fluidic circuit distal wall's inner face and terminate in a rectangular or box-shaped interaction region defined in the cup-shaped fluidic circuit distal wall's inner face. The interaction region could also be cylindrical, which affects the spray pattern.

The cup-shaped fluidic circuit's power nozzles, interaction region and throat can be defined in a disk or pancake shaped insert fitted within the cup, but are preferably molded directly into said cup's interior wall segments. When molded from plastic as a one-piece cup-shaped fluidic circuit, the fluidic cup is easily and economically fitted onto the actuator's sealing post, which typically has a distal or outer face that is substantially flat and fluid impermeable and in flat face sealing engagement with the cup-shaped fluidic circuit distal wall's inner face. The sealing post's peripheral wall and the cup-shaped fluidic circuit's peripheral wall are spaced axially to define an annular fluid channel and the peripheral walls are generally parallel with each other but may be tapered to aid in developing greater fluid velocity and instability.

As a fluidic circuit item for sale or shipment to others, the conformal, unitary, one-piece fluidic circuit is configured for easy and economical incorporation into a nozzle assembly or aerosol spray head actuator body including distally projecting sealing post and a lumen for dispensing or spraying a pressurized liquid product or fluid from a disposable or transportable container to generate an oscillating spray of fluid droplets. The fluidic cup includes a cup-shaped fluidic circuit member having a peripheral wall extending proximally and having a distal radial wall comprising an inner face with features defined therein and an open proximal end configured to receive an actuator's sealing post. The cup-shaped member's peripheral wall and distal radial wall have inner surfaces comprising a fluid channel including a chamber when the cup-shaped member is fitted to the actuator body's sealing post and the chamber is configured to define a fluidic circuit oscillator inlet in fluid communication with an interaction region so when the cup-shaped member is fitted to the body's sealing post and pressurized fluid is introduced, (e.g., by pressing the aerosol spray button and releasing the propellant), the pressurized fluid can enter the fluid channel's chamber and interaction region and generate at least one oscillating flow vortex within the fluid channel's interaction region.

The cup shaped member's distal wall includes a discharge orifice in fluid communication with the chamber's interaction region, and the chamber is configured so that when the cup-shaped member is fitted to the body's sealing post and pressurized fluid is introduced via the actuator body, the chamber's fluidic oscillator inlet is in fluid communication with a first power nozzle and second power nozzle, and the first power nozzle is configured to accelerate the movement of passing pressurized fluid flowing through the first nozzle to form a first jet of fluid flowing into the chamber's interaction region, and the second power nozzle is configured to accelerate the movement of passing pressurized fluid flowing through the second nozzle to form a second jet of fluid flowing into the chamber's interaction region, and the first and second jets impinge upon one another at a selected inter-jet impingement angle and generate oscillating flow vortices within fluid channel's interaction region. As before, the chamber's interaction region is in fluid communication with the discharge orifice defined in said fluidic circuit's distal wall, and the oscillating flow vortices spray from the discharge orifice as an oscillating spray of substantially uniform fluid droplets in a selected spray pattern having a selected spray width and a selected spray thickness.

In the method of the present invention, liquid product manufacturers making or assembling a transportable or disposable pressurized package for spraying or dispensing a liquid product, material or fluid would first obtain or fabricate the conformal fluidic cup circuit for incorporation into a nozzle assembly or aerosol spray head actuator body which typically includes the standard distally projecting sealing post. The actuator body has a lumen for dispensing or spraying a pressurized liquid product or fluid from the disposable or transportable container to generate a spray of fluid droplets, and the conformal fluidic circuit includes the cup-shaped fluidic circuit member having a peripheral wall extending proximally and having a distal radial wall comprising an inner face with features defined therein and an open proximal end configured to receive the actuator's sealing post. The cup-shaped member's peripheral wall and distal radial wall have inner surfaces comprising a fluid channel including a chamber with a fluidic circuit oscillator inlet in fluid communication with an interaction region; and the cup shaped member's peripheral wall preferably has an exterior surface carrying a transversely projecting snap-in locking flange.

In the preferred embodiment of the assembly method, the product manufacturer or assembler next provides or obtains an actuator body with the distally projecting sealing post centered within a body segment having a snap-fit groove configured to resiliently receive and retain the cup shaped member's transversely projecting locking flange. The next step is inserting the sealing post into the cup-shaped member's open distal end and engaging the transversely projecting locking flange into the actuator body's snap fit groove to enclose and seal the fluid channel with the chamber and the fluidic circuit oscillator inlet in fluid communication with the interaction region. A test spray can be performed to demonstrate that when pressurized fluid is introduced into the fluid channel, the pressurized fluid enters the chamber and interaction region and generates at least one oscillating flow vortex within the fluid channel's interaction region.

In the preferred embodiment of the assembly method, the fabricating step comprises molding the conformal fluidic circuit from a plastic material to provide a conformal, unitary, one-piece cup-shaped fluidic circuit member having the distal radial wall inner face features molded therein so that the cup-shaped member's inner surfaces provide an oscillation-inducing geometry which is molded directly into the cup's interior wall segments.

The above and still further objects, features and advantages of the present invention will become apparent upon consideration of the following detailed description of specific embodiments, particularly when taken in conjunction with the accompanying drawings, wherein like reference numerals in the various figures are utilized to designate like components.

BRIEF DESCRIPTION OF THE DRAWINGS

FIG. 9A shows a front or distal perspective view illustrating the discharge orifice and the annular retention bead and FIG. 9B shows installed partial cross section, illustrating the oscillating spray from the discharge orifice and the resilient engagement of the annular retention bead within the actuator's bore, in accordance with the present invention.

DESCRIPTION OF THE PREFERRED EMBODIMENT

Figure 1A:
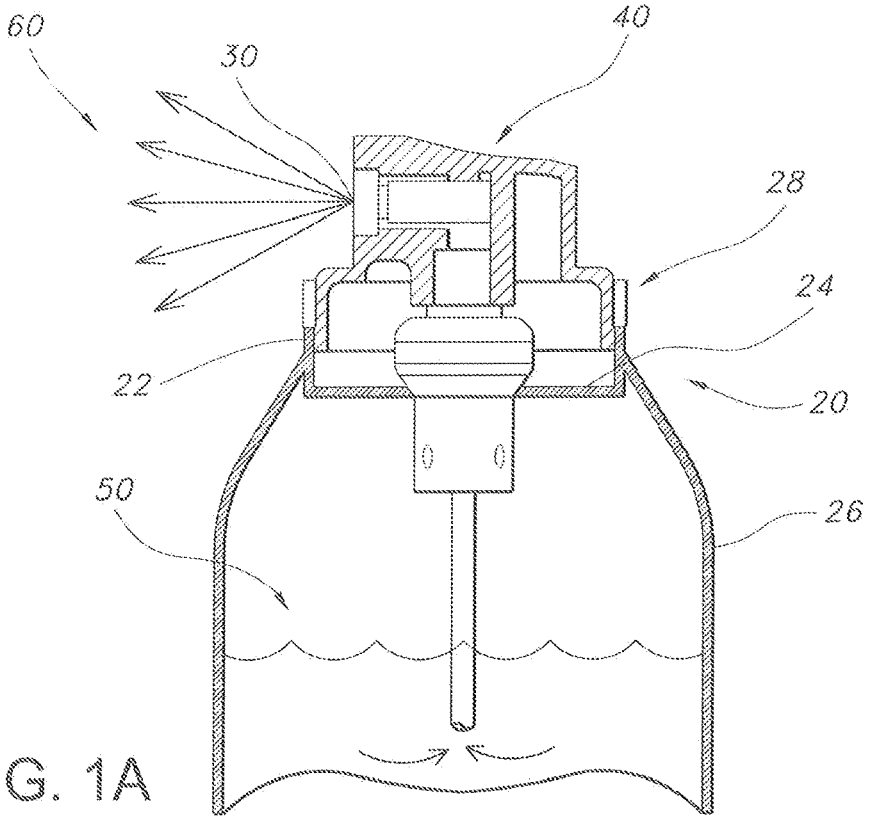
FIG. 1A, is a cross sectional view in elevation of an aerosol sprayer with a typical valve actuator and swirl cup nozzle assembly, in accordance with the Prior Art.
Figure 1B:
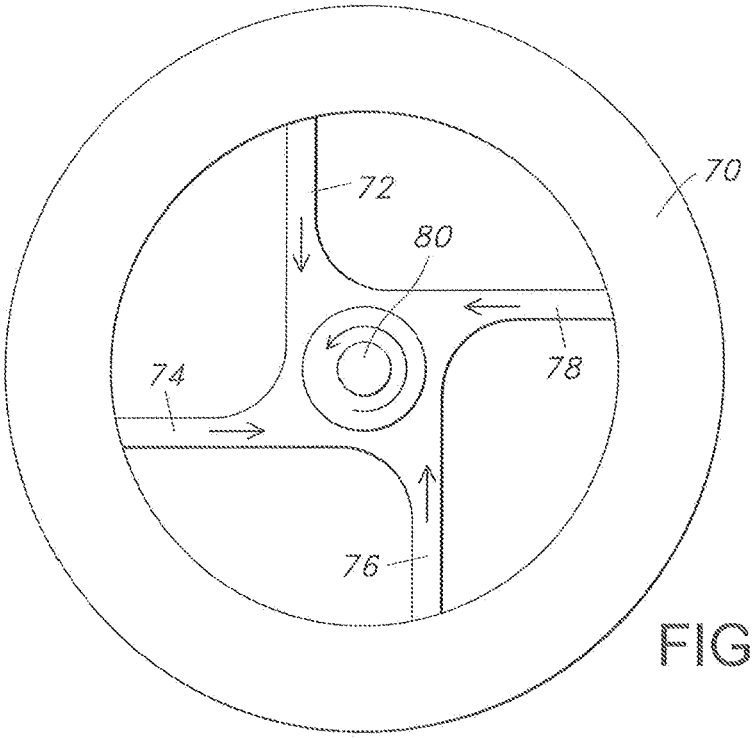
FIG. 1B, is a plan view of a standard swirl cup as used with aerosol sprayers and trigger sprayers, in accordance with the Prior Art.
Figure 2:
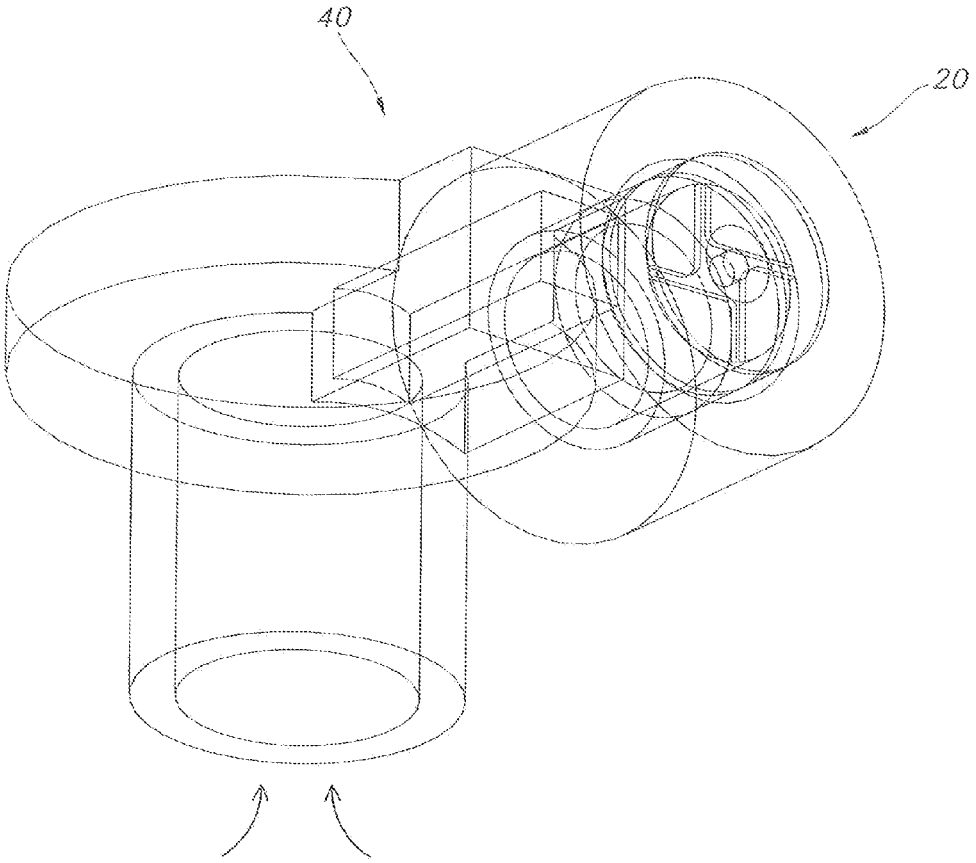
FIG. 2 is a schematic diagram illustrating the typical actuator and nozzle assembly including the standard swirl cup of FIGS. 1A and 1B as used with aerosol sprayers, in accordance with the Prior Art.

FIGS. 1A-2 show typical features of aerosol spray actuators and swirl cup nozzles used in the prior art, and these figures are described here to provide added background and context. Referring specifically to FIG. 1A, a transportable, disposable propellant pressurized aerosol package 20 has container 26 enclosing a liquid product 50 and an actuator 40 which controls a valve mounted within a valve cup 24 which is affixed within the neck 28 of the container and supported by container flange 22. Actuator 40 is depressed to open the valve and drive pressurized liquid through a spin-cup equipped nozzle 30 to produce an aerosol spray 60. FIG. 1B illustrates the inner workings of an actual spin cup 70 taken from a typical nozzle (e.g., 30) where four lumens 72, 74, 76, 78 are aimed to make four tangential flows enter a spinning chamber 80 where the continuously spinning liquid flows combine and emerge from the central discharge passage 80 as a substantially continuous spray of droplets of varying sizes (e.g., 60), including the "fines" or miniscule droplets of fluid which many users find to be useless.

FIG. 2 is a schematic perspective diagram illustrating the typical actuator and nozzle assembly including the standard swirl cup of FIGS. 1A and 18 as used with aerosol sprayers, where the solid lines illustrate the outer surfaces of an actuator (e.g., 40) and the phantom or dashed lines show hidden features including the interior surfaces of seal cup 70. Presently, swirl cups (e.g., 70) are fitted on to an actuator (e.g., 40) and used with either manually pumped trigger sprayers or aerosol sprayer (e.g., 20). It is a simple construction that does not require an insert and separate housing. The fluidic cup oscillator of the present invention builds upon this concept illustrated in FIGS. 1A-2, but replaces the swirl cup's "spin" geometry with a fluidic geometry enabling fluidic sprays instead of a swirl spray. As noted above, swirl sprays are typically round, whereas fluidic sprays are characterized by planar, rectangular or square cross sections with consistent droplet size. Thus, the spray from a nozzle assembly made in accordance with the present invention can be adapted or customized for various applications and still retains the simple and economical construction characteristics of a "swirl" cup.

Figure 4:
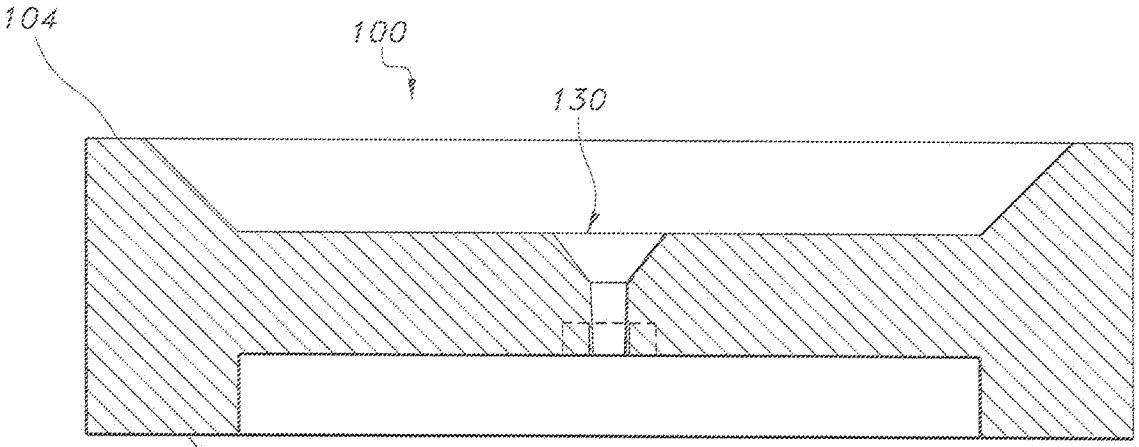
FIG. 4 is a cross-sectional diagram illustrating one embodiment of the fluidic cup's distal wall, interior fluidic geometry and exterior surface and power nozzle from the right side, in accordance with the present invention.
Figure 5:
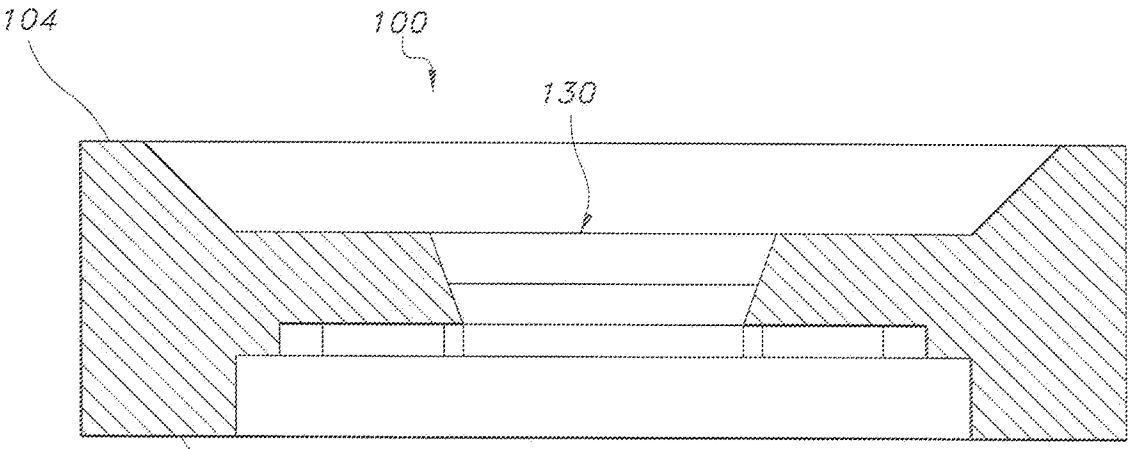
FIG. 5 is another cross-sectional diagram illustrating the embodiment of FIG. 4 from a viewpoint 90 degrees from the view of FIG. 4, illustrating the fluidic cup's distal wall, interior fluidic geometry and exterior surface and power nozzle from above, in accordance with the present invention.
Figure 6:
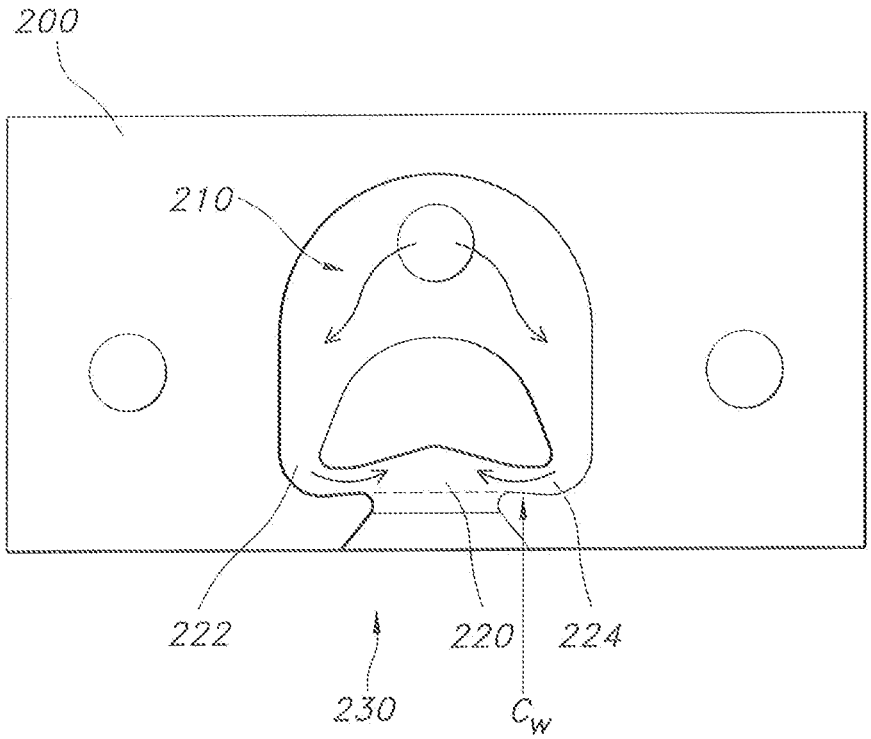
FIG. 6 is a schematic diagram illustrating the operational principals of an equivalent planar fluidic circuit having the flag mushroom configuration used to generate rectangular 3D sprays and showing the downstream location of the interaction region, between the first and second power nozzles, in accordance with the present invention.
Figure 7A:
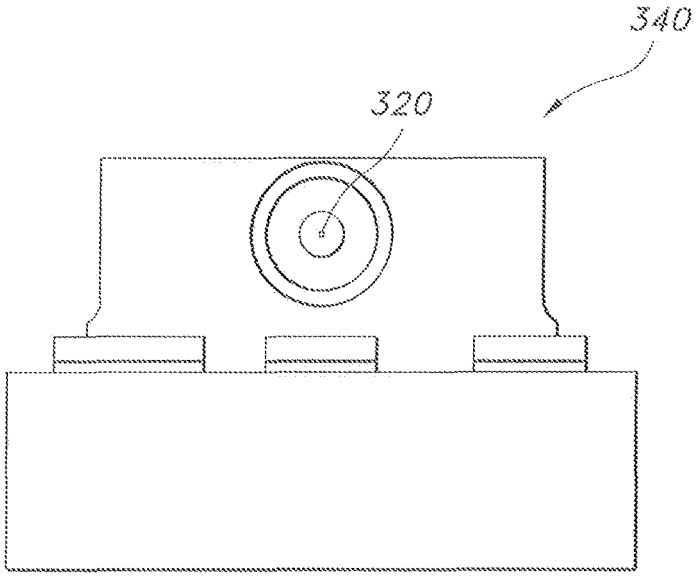
FIG. 7A is a photograph illustrating an actuator body having a bore with an uncovered distally projecting sealing post, in accordance with the present invention.
Figure 7B:
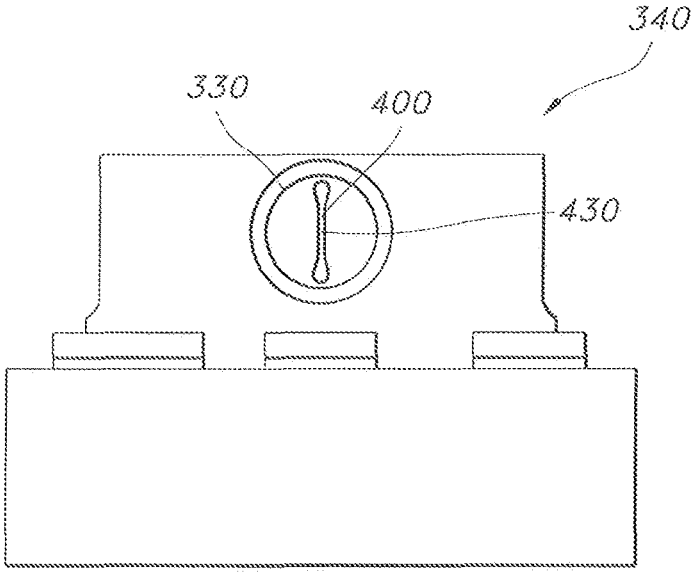
FIG. 7B is a photograph illustrating the actuator body and bore of FIG. 7A with a fluidic cup installed over the distally projecting sealing post, in accordance with the present invention.
Figure 8:
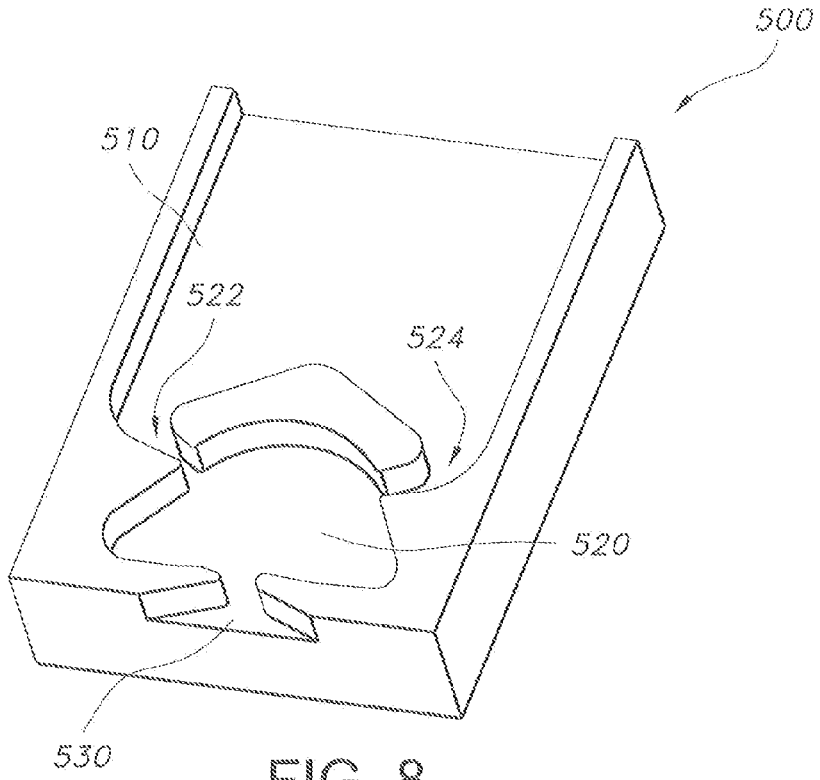
FIG. 8 is a diagram illustrating the operational principals of a second equivalent planar fluidic circuit having the mushroom configuration and showing the location of the interaction region between the first and second power nozzles and the downstream location of the throat or exit, in accordance with the present invention.

FIGS. 3A-13 illustrate structural features of exemplary embodiments of the conformal fluidic cup oscillator (e.g., 100, 400, 600 or 700) of present invention and the method of assembling and using the components of the present invention. This invention describes and illustrates conformal, cup-shaped fluidic circuit geometries which emulate applicant's widely appreciated planar fluidic geometry configurations, but which have been engineered to generate the desired oscillating sprays from a conformal configuration such as a fluidic cup. Two exemplary planar fluidic oscillator configurations discussed here are: (1) the flag mushroom circuit (which, in its planar form, is illustrated in FIG. 6) and (2) the mushroom circuit (which, in its planar form, is illustrated in FIG. 8).

Figure 3A:
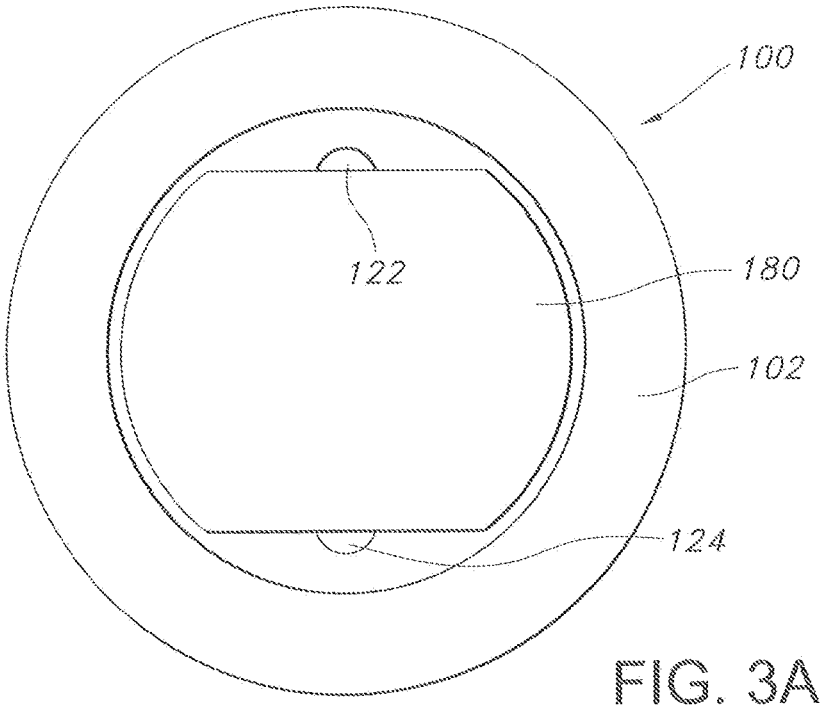
FIGS. 3A and 3B are photographs illustrating the interior surfaces of a prototype fluidic cup oscillator showing the oscillation-inducing geometry or features of for the selected fluidic oscillator embodiment, in accordance with the present invention.
Figure 3B:
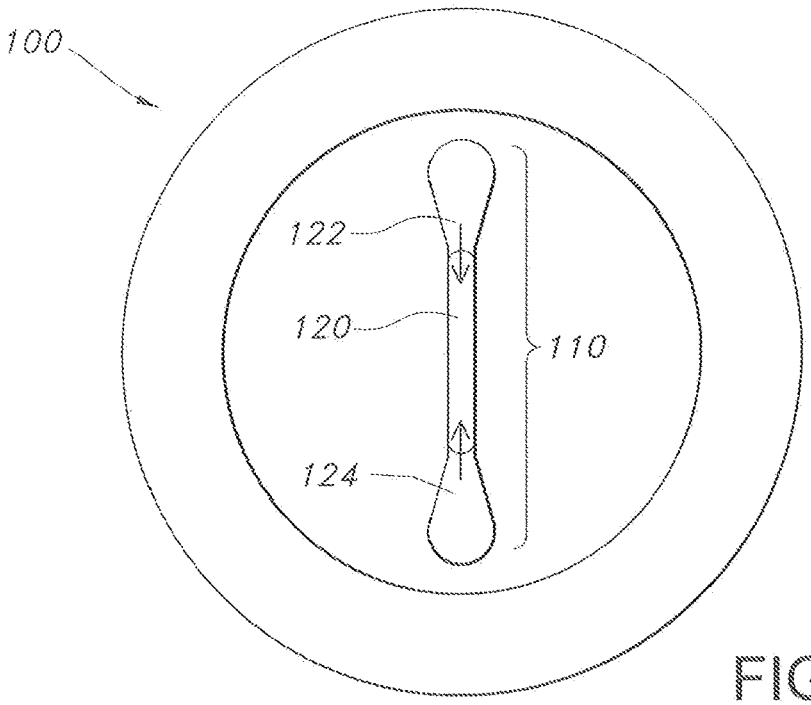

FIGS. 3-5 illustrate the flag mushroom circuit equivalent embodiment, as converted in to a fluidic cup. Referring now to FIGS. 3A and 38, a prototype fluidic oscillator 100 includes a two channel oscillation-inducing geometry 110 having fluid steering features and is configured as a substantially planar disk having an underside or proximal side 102 opposing a distal side 104 (see FIGS. 4 and 5). The fluid oscillation-inducing geometry 110 is preferably molded into underside or proximal side 102. In the illustrated embodiment, oscillation-inducing geometry 110 operates within a chamber with an interaction region 120 between a first power nozzle 122 and second power nozzle 124, where first power nozzle 122 is configured to accelerate the movement of passing pressurized fluid flowing through the first nozzle to form a first jet of fluid flowing into the chamber's interaction region 120, and the second power nozzle 124 is configured to accelerate the movement of passing pressurized fluid flowing through the second nozzle to form a second jet of fluid flowing into the chamber's interaction region 120. The first and second jets collide and impinge upon one another at a selected inter-jet impingement angle (e.g., 180 degrees, meaning the jets impinge from opposite sides) and generate oscillating flow vortices within interaction region 120 which is in fluid communication with a discharge orifice or power nozzle 130 defined in the fluidic circuit's distal side surface 104, and the oscillating flow vortices spray droplets through the discharge orifice as an oscillating spray of substantially uniform fluid droplets in a selected (e.g., rectangular) spray pattern having a selected spray width and a selected spray thickness.

FIG. 3A illustrates the prototype fluidic oscillator 100 and shows the placement of a planar fluid sealing insert 180 covering part of the two channel oscillation-inducing geometry 110, once affixed to proximal side 102, to force fluid to flow into the wider portions or inlets of the first power nozzle 122 and second power nozzle 124. The fluidic cup 100 and sealing insert 180 illustrated in FIGS. 3A-5 were molded from plastic materials but could be fabricated from any durable, resilient fluid impermeable material. As best seen in FIGS. 4 and 5, prototype fluidic oscillator 100 is small and has an outer diameter of 5.638 mm and first power nozzle 122 and second power nozzle 124 are defined as grooves or troughs having a selected depth (e.g., 0.018 mm) with tapered sidewalls to provide a venturi-like effect. Discharge orifice or power nozzle 130 is an elongated slot-like aperture having flared or angled sidewalls, as best seen in FIGS. 4 and 5.

In the fluidic cup embodiment 100 of FIGS. 3A-5, applicants have effectively developed a replacement for the four channel swirl cup 70, replacing it with a two-channel fluidic oscillator based on the operating principals of applicant's own planar flag mushroom circuit geometry. This results in a robust, easily variable rectangular spray pattern, with small droplet size. The fluidic circuit of FIGS. 3A-5 is capable of reliably achieving a generated spray fan angle ranging from 40° to 60° and a spray thickness ranging from 5° to 20°. These spray pattern performance measurements were taken at a flow rate range of 50-90 mLPM at 30 psi. The liquid product flow rate can be adjusted by varying the geometry's groove or trough depth "Pw", shown 0.18 mm in the embodiment of FIG. 4 & FIG. 5. The spray's fan angle is controlled by the Upper Taper in throat or discharge 130, shown as 75° in FIG. 4. The spray thickness is controlled by the Lower Taper in the throat 130, shown as 10° in FIG. 4. The Upper Taper has been tested at values from 50° to 75°, and the Lower Taper has been tested at values from 0° to 20°. By adjusting these dimensions, fluidic cup 100 can be tailored to spray a wide range of liquid products in either aerosol (e.g., like FIG. 1) or trigger spray (FIG. 13) packages.

Turning now to FIG. 6, equivalent planar fluidic circuit 200 has the flag mushroom configuration used to generate rectangular 30 sprays. In the planar form, the fluidic geometry is machined on a "flat chip", which is then inserted in to a rectangular housing slot (not shown) to seal the fluidic passages of geometry 210. There are two power nozzles 222, 224 shown by width "w", that are directly opposed to each other (180 degrees). There is also the interaction region cavity 220 shown at the impingement point. The output of fluidic circuit 200 is a rectangular 30 spray, whose fan and thickness is controlled by varying the floor taper angles of geometry 210. In the new cup-shaped conformal oscillator geometry of the present invention, (e.g., shown in FIGS. 3A-5), a functionally equivalent fluidic circuit is provided. In the new configuration, FIGS. 3A-5 shows the power nozzles 122, 124, which are comparable to 222 and 224 (see, truncated at the dashed line in FIG. 6). The "front view" in FIG. 6, is comparable to a "top view" in FIG. 3. Thus, the power nozzle width shown by "w" in FIG. 6, is comparable to the circuit feature in FIG. 3, which, for example, is 0.18 mm (as shown in FIG. 5). FIG. 4, shows placement of sealing insert 180, which is actually part of the actuator (e.g., actuator body or housing 340 as shown in FIG. 7A) that seals the power nozzles, (e.g., as best seen in FIG. 7A), with a feed area available for the power nozzles. This sealing insert 120 preferably presses against an actuator's sealing post 320 to define a volume that effectively functions much like the interaction region cavity 220 shown in FIG. 6. The exhaust, throat or discharge port 230 of the planar fluidic circuit (e.g., 230, the part below the dashed line in FIG. 6) is comparable to discharge port 130 in FIGS. 4 and 5.

Turning now to FIGS. 7A and 78, actuator body or housing 340 includes a counter-sunk bore 330 with a distally projecting cylindrical sealing post 320 terminating distally in a substantially circular distal sealing surface. A fluidic cup 400 is preferably configured as a one-piece conformal fluidic oscillator and sealably engages sealing post 320 as shown in FIG. 78. Post 320 in actuator body or housing 340 serves to seal the fluidic circuit so that liquid product or fluid (e.g., like 50) is emitted or sprayed only from discharge port 430 when the user chooses to spray or apply the liquid product. Fluidic cup 400 is essentially flag mushroom circuit equivalent having an output from discharge port 430 in the form of a rectangular 30 spray, and so the spray's fan angle and thickness are controlled by changing the taper angles just as for fluidic cup 100 as illustrated in FIG. 4.

Figure 9A:
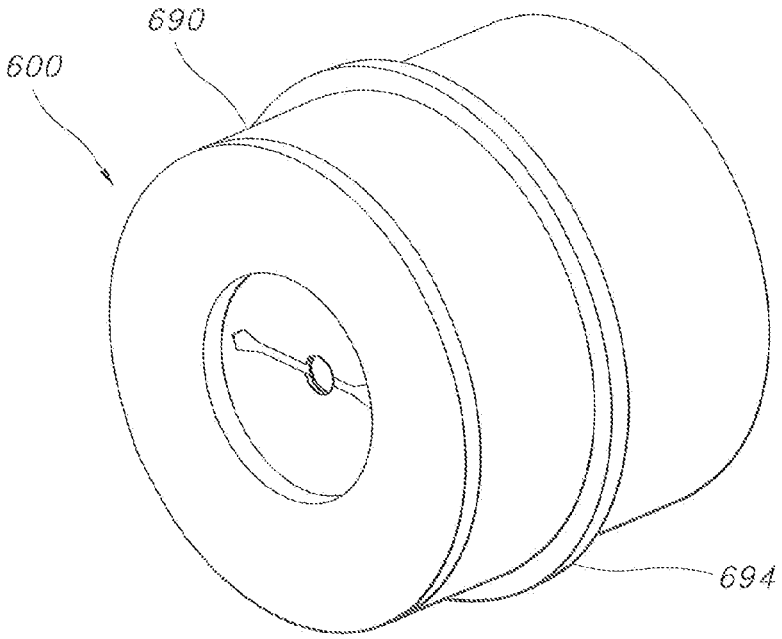
FIGS. 9A and 9B illustrate a prototype mushroom-equivalent fluidic cup embodiment.
Figure 9B:
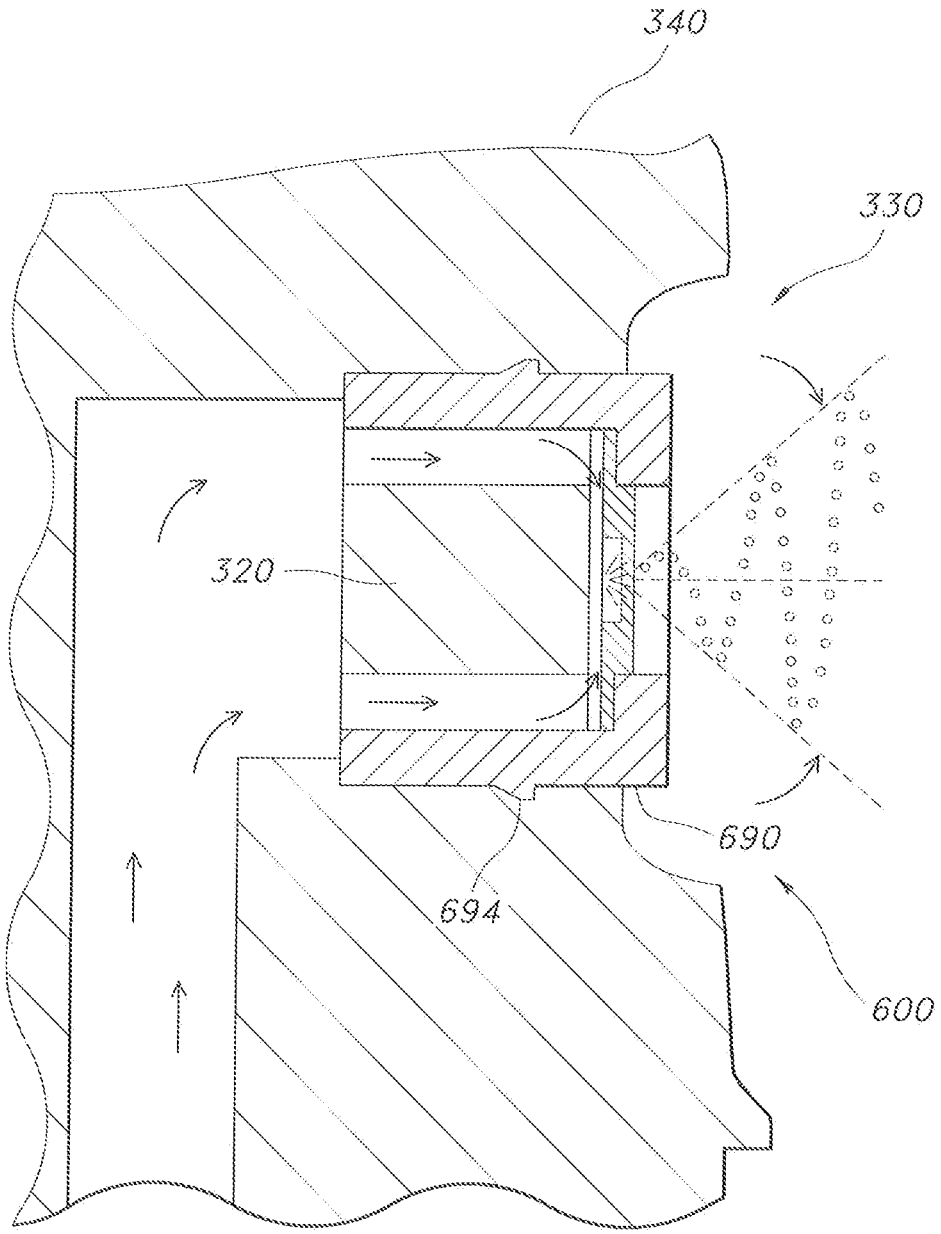

Another embodiment of the fluidic cup (mushroom cup 600) has been developed to emulate the operating mechanics of the planar mushroom circuit 500 (shown in FIG. 8). The flag mushroom cup 100 described above emits a spray comprised of a sheet oscillating in a plane normal to the centerline of the power nozzles 122, 124. The mushroom cup 600 (as best seen in FIGS. 9A-8 and FIGS. 11A-11D) emits a single moving jet oscillating in space to form a flat fan in plane with the power nozzles 622, 624. FIG. 9A is a photograph showing a mushroom-equivalent fluidic cup 600 (front or distal perspective view) illustrating the discharge orifice 630 and the annular retention bead and FIG. 98 shows mushroom-equivalent fluidic cup 600 installed in actuator body 340, within bore 330 (best seen in FIG. 7A) in partial cross section, and illustrating the oscillating spray from discharge orifice 630 and the resilient engagement of the cup member's annular retention bead within actuator bore 330. Referring now to FIG. 98, liquid product or fluid is shown flowing into fluidic cup and into the oscillator's power nozzles to generate the mushroom cup oscillator's spray fan which remains in plane with the power nozzles 622, 624 (best seen in FIGS. 10A-11D), and with the structure of fluidic cup 600, the probability of the spray fan rotating out of a permanently fixed plane relative to the power nozzles 622, 624 is greatly reduced. From the liquid product vendor's perspective, this results in improved reliability. The mushroom cup 600 is also favorable from a manufacturing and injection molding standpoint. The exit orifice or 630 through which the fluid is exhausted from the interaction region 620 is a 0.3 mm-0.5 mm diameter through hole, which can be formed with a simple pin, as an alternative to the complex and difficult to maintain tooling required to form the tapered slot 130 of the flag mushroom cup 100.

Figure 10C:
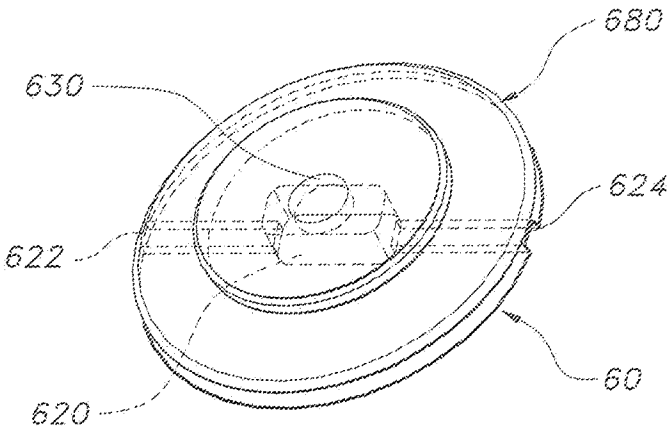
FIGS. 10A-10D are diagrams illustrating a prototype fluidic cup mushroom-equivalent insert having a substantially circular discharge or exit lumen, and showing the two power nozzles and interaction region, in accordance with the present invention.
Figure 10D:
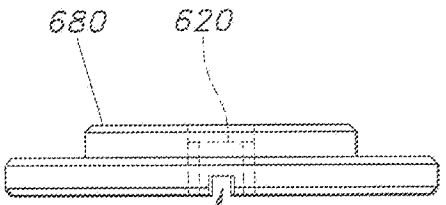
Figure 10A:
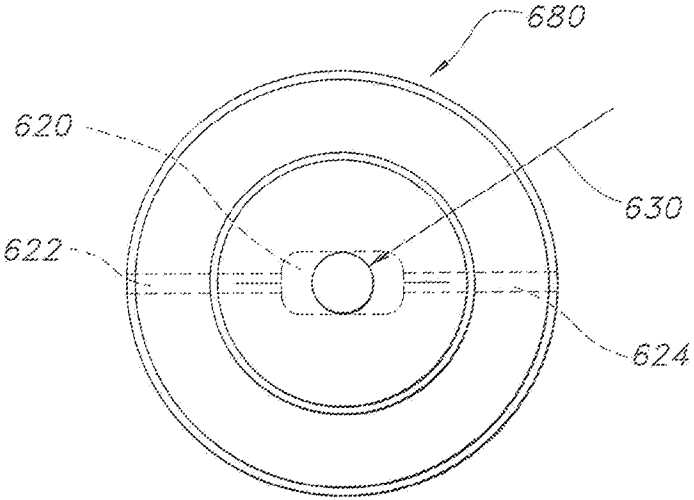
Figure 10B:
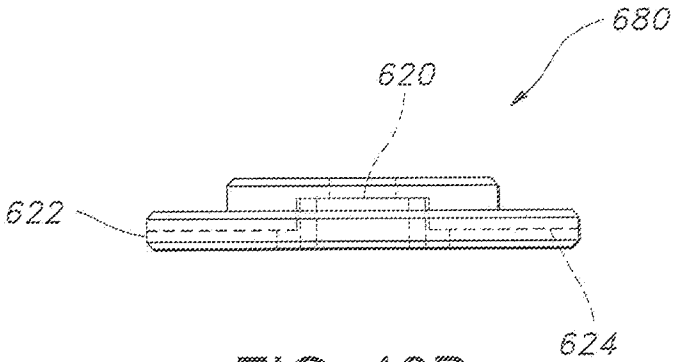
Figure 11C:
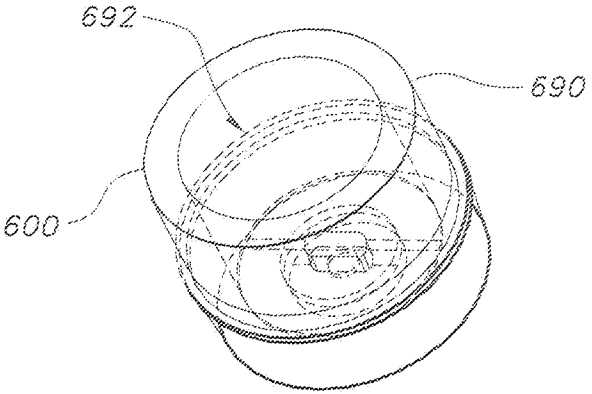
FIGS. 11A-11D are diagrams illustrating a prototype fluidic cup assembly using the mushroom-equivalent insert of FIGS. 10A-10D, in accordance with the present invention.
Figure 11D:
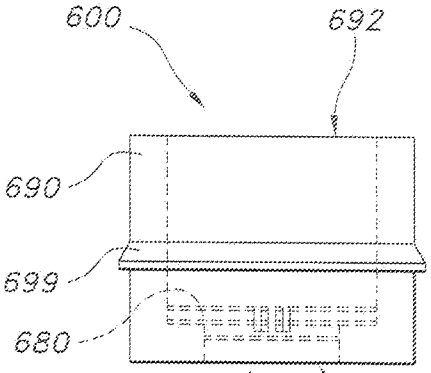
Figure 11A:
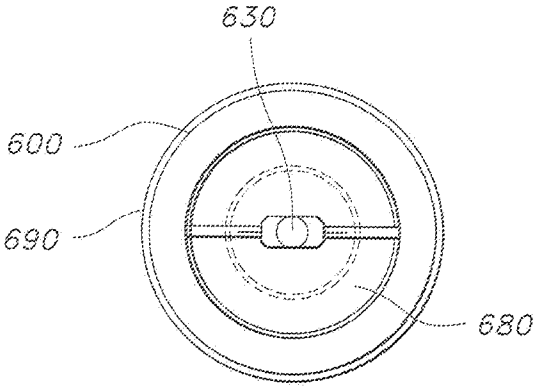
Figure 11B:
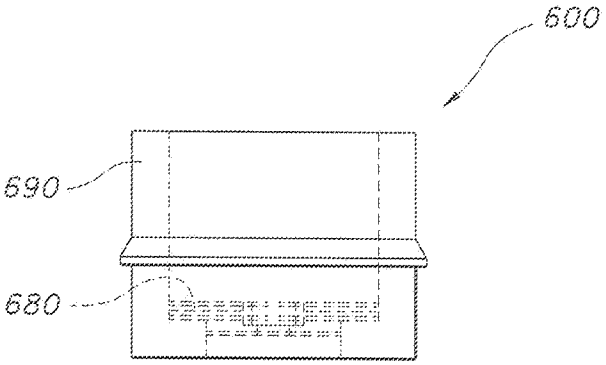

Referring now to FIGS. 10A-10D and 11A-11D, the comparison between the planar mushroom fluidic oscillator 500 and mushroom cup oscillator 600 can be examined. The rectangular throat or exit 530 in planar oscillator 500 is reconfigured into a circular 0.25 mm exit or discharge port 630 as shown in FIGS. 10A and 108. However, one may retain its original rectangular shape as well. The opposing power nozzles 522 and 524 and interaction region 520 are reconfigured as opposing power nozzles 622 and 624 and interaction region 620 in the disc shaped insert 680 for the cup-shaped fluidic 600 illustrated in FIGS. 10A-11D.

FIGS. 10A-10D and 11A-11D illustrate fluidic cup oscillator 600 and shows the placement of molded disc-shaped insert 680 which includes the two channel oscillation-inducing geometry 610 and is carried within the substantially cylindrical cup member 690, which has an open proximal end 692 and a flanged distal end including an inwardly projecting wall segment 694 having a circular distal opening 696. Once disc-shaped insert 680 is affixed within cup member 690 abutting the flanged wall segment proximate the circular distal opening 696, discharge port 630 is aimed distally. In operation, liquid product or fluid (e.g., 50) introduced into fluidic cup oscillator 600 flow into the wider portions or inlets of the first power nozzle 622 and second power nozzle 624. The fluidic insert disc 680 and cup member 690 are preferably injection molded from plastic materials but could be fabricated from any durable, resilient fluid impermeable material. As shown in FIGS. 10A-11D, fluidic oscillator 600 is small and has an outer diameter of 4.765 mm and first power nozzle 622 and second power nozzle 624 are defined as grooves or troughs having a selected depth (e.g., 0.014 mm) with tapered sidewalls narrowing to 0.15 mm to provide a venturi-like effect. Discharge office or power nozzle 630 is a circular lumen or aperture having substantially straight pin-hole like sidewalls with a diameter of 0.25 mm, as best seen in FIG. 10A.

Turning now to the embodiment illustrated in FIGS. 12A-12E, the fluidic cup of the present invention is preferably configured as a one-piece injection-molded plastic fluidic cup-shaped conformal nozzle 700 and does not require a multi-component insert and housing assembly. The fluidic oscillator's operative features or geometry 710 are preferably molded directly into the cup's interior surfaces and the cup is configured for easy installation to an actuator body (e.g., 340). This eliminates the need for multi-component fluidic cup assembly made from a fluidic circuit defining insert which is received within a cup-shaped member's cavity (as in the embodiments of FIGS. 9A-11D). The fluidic cup embodiment 700 illustrated in FIGS. 12A-12E provides a novel fluidic circuit which functions like a planar fluidic circuit but which has the fluidic circuit's oscillation inducing features and geometry 710 molded in-situ within a cup-shaped member so that one installed on an actuator's fluid impermeable, resilient support member (e.g., such as sealing post 320) a complete and effective fluidic oscillator nozzle is provided.

Figure 12D:
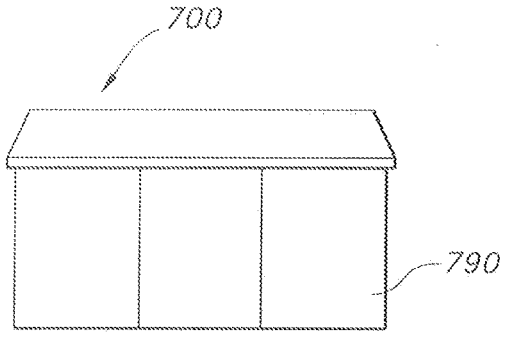
FIGS. 12A-12E are diagrams illustrating a one-piece, unitary fluidic cup oscillator configured with integral fluidic oscillator inducing features molded into the cup's interior surfaces, with a substantially circular discharge orifice or exit lumen, and showing the two opposing venture-shaped power nozzles aimed at the interaction region, in accordance with the present invention.
Figure 12E:
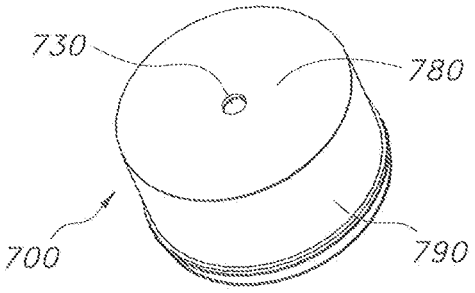
Figure 12C:
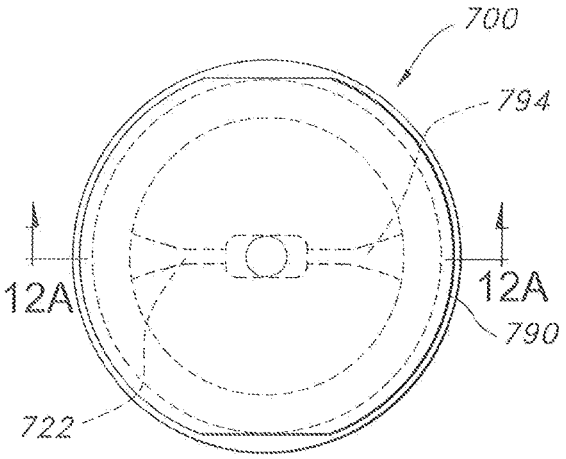

Referring specifically to FIGS. 12A-12E, a comparison between the planar fluidic oscillator described above and one-piece fluidic cup oscillator 700 can be appreciated. The circular (0.25 mm diameter) exit or discharge port 730 is proximal of interaction region 720. The opposing tapered venturi-shaped power nozzles 722 and 724 and interaction region 720 molded in-situ within the interior surface of distal end-wall 780. The molded interior surface of circular, planar or disc-shaped end wall 780 includes grooves or troughs defining the two channel oscillation-inducing geometry 710 and is carried within the substantially cylindrical sidewall segment 790, which has an open proximal end 792 and a closed distal end including a distal surface having substantially centered circular distal port or throat 730 defined therethrough so that discharge port 730 is aimed distally. As best seen in FIGS. 12C and 12E, one-piece fluidic cup oscillator 700 is optionally configured with first and second parallel opposing substantially planar "wrench-flat" segments 792 defined in cylindrical sidewall segment 790.

Figure 12B:
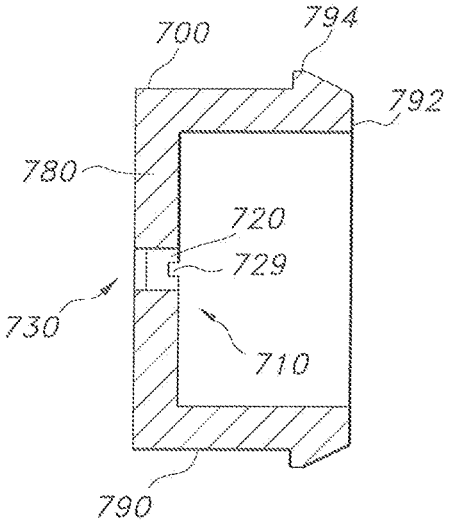
Figure 12A:
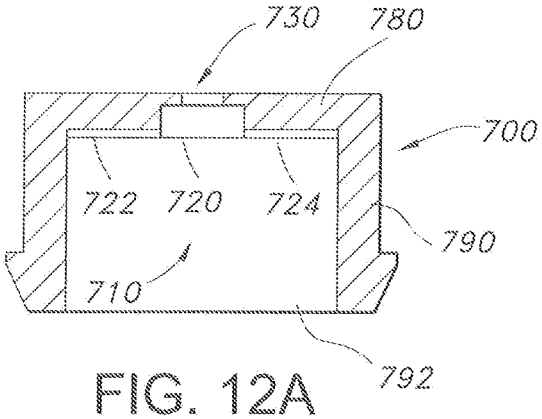

In operation, liquid product or fluid (e.g., 50) introduced into one-piece fluidic cup oscillator 700 flows into the wider portions or inlets of the first power nozzle 722 and second power nozzle 724. The one-piece fluidic cup oscillator 700 is preferably injection molded from plastic materials but could be fabricated from any durable, resilient fluid impermeable material. As shown in FIGS. 12A-12E, one-piece fluidic cup oscillator 700 is small and has a small outer diameter (e.g., of 4.765 mm) and first power nozzle 722 and second power nozzle 724 are defined as grooves or troughs having a selected depth (e.g., 0.014 mm) with tapered sidewalls narrowing to 0.15 mm to provide the necessary venturi-like effect. Discharge orifice or power nozzle 630 is a circular lumen or aperture having substantially straight pin-hole like sidewalls with a diameter of approximately 0.25 mm, as best seen in FIGS. 12A-12C.

Figure 13:
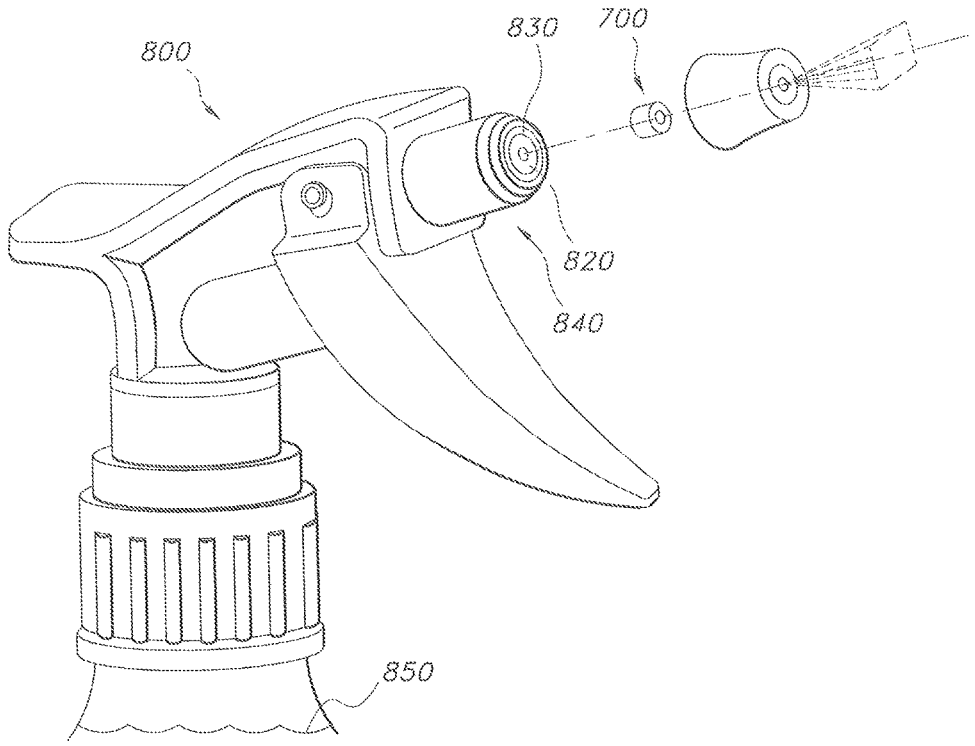
FIG. 13 is an exploded perspective view illustrating a hand-operated trigger sprayer configured for use with the one-piece, unitary fluidic cup oscillator of FIGS. 12A-E or the fluidic cup assembly of FIGS. 9A-11D, in accordance with the present invention.

One-piece fluidic cup oscillator 700 can be installed in an actuator like that shown in FIG. 78, as a replacement for mushroom-equivalent fluidic cup 600, and the benefits of using one-piece fluidic cup oscillator 700 include: (1) no need to change tooling for the liquid product vendor, (2) no need to change the liquid product vendor's manufacturing line, (3) simpler to manage, and (4) the fluidic cup nozzle assemblies can be configured to provide application-optimized fluidic sprays for each of the liquid product vendor's product offerings. The conformal or cup-shaped fluidic oscillator structures and methods of the present invention can be used in various applications ranging from low flow rates (e.g., <50 mllmin at 40 psi, for pressurized aerosols (e.g., like FIG. 1A, or with manual pump trigger sprays (e.g., 800, as shown in FIG. 13). The conformal fluidic geometry method can also be adapted for use with high flow rate applications (e.g. showerheads, which may be configured as a single fluidic cup that has one or multiple exits).

Persons having skill in the art will appreciate that modifications of the illustrated embodiments of the present invention can provide the similar benefits, for example, the interaction region 620 indicated in FIG. 10A, can be circular (rather than rectangular). In such cases the oscillation mechanism is different than the mushroom circuit shown in FIG. 8, and results in a three-dimensional spray rather than rectangular or planar sprays produced by examples shown in FIGS. 8, 98 and 10A-10D. In such a case (with a circular interaction region), the fluidic cup can also be referred to as the 30 mushroom and will generate a 30 spray pattern of very uniform droplets. The conformal or fluidic cup oscillators illustrated herein (e.g., 100, 400, 600 or 700} are readily configured to replace the prior art swirl cups in the traditional aerosol (or trigger sprayer) actuators. Advantages include a wide rectangular or planar spray pattern instead of a narrow non-uniform conical pattern. Fluidic oscillator generated droplets have a size that is generally much more consistent than for standard aerosol sprays while reducing unwanted fines and misting. The structures and methods of the present invention are adaptable to a variety of transportable or disposable cleaning products or devices e.g., carpet cleaners, shower room cleaners, paint sprayers and showerheads.

FIG. 13 is an exploded perspective view illustrating a hand-operated trigger sprayer 800 configured for use with any of these fluidic cup configurations (e.g., 100, 400, 600 or 700). Preferably, trigger sprayer 800 is configured with the one-piece, unitary fluidic cup oscillator 700 of FIGS. 12A-E or the fluidic cup assembly 600 of FIGS. 9A-11D. The fluidic cup is useful with both hand-pumped trigger sprayers and propellant filled aerosol sprayers and can be configured to generate different sprays for different liquid or fluid products. Fluidic oscillator circuits are shown which can be configured to project a rectangular spray pattern (e.g., a 30 or rectangular oscillating pattern of uniform droplets). The fluidic oscillator structure's fluid dynamic mechanism for generating the oscillation is conceptually similar to that shown and described in commonly owned U.S. Pat. Nos. 7,267,290 and 7,478,764 (Gopalan et al) which describe a planar mushroom fluidic circuit's operation; both of these commonly owned patents are incorporated herein in their entireties. The fluidic cup structure (e.g., 100, 400, 600 or 700) has a fluid inlet defined within the cup's proximally projecting cylindrical sidewall (see FIG. 98), and the exemplary fluid inlet is annular and of constant cross section, but the fluidic cup's fluid inlet can also be tapered or include step discontinuities to enhance pressurized fluid instability.

It will be appreciated that the novel fluidic circuit of the present invention (e.g., 100, 400, 600 or 700) is adapted for many conformal configurations. There are several consumer applications such as aerosol sprayers or trigger sprayers (e.g., 800) where it is desirable to customize sprays. Fluidic sprays are very useful in these cases but adapting typical commercial aerosol sprayers and trigger sprayers to accept the standard fluidic oscillator configurations would cause unreasonable product manufacturing process changes to current aerosol sprayers and trigger sprayers thus making them much more expensive.

A nozzle assembly or spray head including a lumen or duct for dispensing or spraying a pressurized liquid product or fluid from a valve, pump or actuator assembly (e.g., 340 or 840) draws from a disposable or transportable container to generate an oscillating spray of very uniform fluid droplets. The fluidic cup nozzle assembly includes an actuator body (e.g., 340 or 840) having a distally projecting sealing post (e.g., 320 or 820) having a post peripheral wall terminating at a distal or outer face, and the actuator body includes a fluid passage communicating with the lumen.

Cup-shaped fluidic circuit (e.g., 100, 400, 600 or 700) is mounted in the actuator body member having a peripheral wall extending proximally into a bore (e.g., 330 or 830) in the actuator body radially outwardly of the sealing post (e.g., 320 or 820) and having a distal radial wall comprising an inner face opposing the sealing post's distal or outer face to define a fluid channel including a chamber having an interaction region between the body's sealing post (e.g., 320 or 820) and said cup-shaped fluidic circuit's peripheral wall and distal wall: the chamber is in fluid communication with the actuator body's fluid passage to define a fluidic circuit oscillator inlet so the pressurized fluid can enter the fluid channel's chamber and interaction region (e.g., 120, 620 or 720). The cup-shaped fluidic circuit distal wall's inner face carries the fluidic geometry (e.g., 110, 610 or 710), so it is configured to define within the chamber a first power nozzle and second power nozzle, where the first power nozzle is configured to accelerate the movement of passing pressurized fluid flowing through the first nozzle to form a first jet of fluid flowing into the chamber's interaction region (e.g., 120, 620 or 720), and the second power nozzle is configured to accelerate the movement of passing pressurized fluid flowing through the second nozzle to form a second jet of fluid flowing into the chamber's interaction region (e.g., 120, 620 or 720). The first and second jets impinge upon one another at a selected inter-jet impingement angle (e.g., 180 degrees, meaning the jets impinge from opposite sides) and generate oscillating flow vortices within the fluid channel's interaction region (e.g., 120, 620 or 720) which is in fluid communication with a discharge orifice or power nozzle (e.g., 130, 630 or 730) defined in the fluidic cup's distal wall, and the oscillating flow vortices spray droplets through the discharge orifice (e.g., 130, 630 or 730) as an oscillating spray of substantially uniform fluid droplets in a selected (e.g., rectangular) spray pattern having a selected spray width and a selected spray thickness, as shown in FIGS. 98 and 13).

The first and second power nozzles are preferably venturi-shaped or tapered channels or grooves in the cup-shaped fluidic circuit distal wall's inner face and terminate in a rectangular or box-shaped interaction region (e.g., 120, 620 or 720) carried by or defined in the cup-shaped fluidic circuit distal wall's inner face. The interaction region could also be cylindrical, which affects the spray pattern.

The cup-shaped fluidic circuit's power nozzles, interaction region and throat can be defined in a disk or pancake shaped insert fitted within the cup (e.g., 100 400 or 600), but are preferably molded directly into interior wall segments in situ to provide one-piece fluidic cup oscillator 700. When molded from plastic as a one-piece cup-shaped fluidic circuit 700, the fluidic cup is easily and economically fitted onto the actuator's sealing post {e.g., 320), which typically has a distal or outer face that is substantially flat and fluid impermeable and in flat face sealing engagement with the cup-shaped fluidic circuit distal wall's inner face. The sealing post's peripheral wall and the cup-shaped fluidic circuit's peripheral wall (e.g., 690 or 790) are spaced axially to define an annular fluid channel and (as shown in FIG. 98) the peripheral walls are generally parallel with each other but may be tapered to aid in developing greater fluid velocity and instability.

As a fluidic circuit item for sale or shipment to others, the conformal, unitary, one-piece fluidic circuit 700 is configured for easy and economical incorporation into a nozzle assembly or aerosol spray head actuator body including distally projecting sealing post (e.g., 320) and a lumen for dispensing or spraying a pressurized liquid product or fluid from a disposable or transportable container to generate an oscillating spray of fluid droplets. The fluidic cup (e.g., 100, 400, 600 or 700) includes a cup-shaped fluidic circuit member having a peripheral wall extending proximally and having a distal radial wall comprising an inner face with fluid constraining operative features or a fluidic geometry (e.g., 110, 610 or 710) defined therein and an open proximal end (e.g., 692 or 792) configured to receive an actuator's sealing post (e.g., 320). The cup-shaped member's peripheral wall and distal radial wall have inner surfaces comprising a fluid channel including a chamber when the cup-shaped member is fitted to the actuator body's sealing post and the chamber is configured to define a fluidic circuit oscillator inlet in fluid communication with an interaction region so when the cup-shaped member is fitted to the body's sealing post and pressurized fluid is introduced, (e.g., by pressing the aerosol spray button and releasing the propellant), the pressurized fluid can enter the fluid channel's chamber and interaction region and generate at least one oscillating flow vortex within the fluid channel's interaction region (e.g., 120, 620 or 720).

The cup shaped member's distal wall includes a discharge orifice (e.g., 130, 630 or 730) in fluid communication with the chamber's interaction region, and the chamber is configured so that when the cup-shaped member (e.g., 100, 400, 600 or 700) is fitted to the body's sealing post and pressurized fluid is introduced via the actuator body, the chamber's fluidic oscillator inlet is in fluid communication with a first power nozzle and second power nozzle, and the first power nozzle is configured to accelerate the movement of passing pressurized fluid flowing through the first nozzle to form a first jet of fluid flowing into the chamber's interaction region, and the second power nozzle is configured to accelerate the movement of passing pressurized fluid flowing through the second nozzle to form a second jet of fluid flowing into the chamber's interaction region, and the first and second jets impinge upon one another at a selected inter-jet impingement angle and generate oscillating flow vortices within fluid channel's interaction region. As before, the chamber's interaction region (e.g., 120, 620 or 720) is in fluid communication with the discharge orifice (e.g., 130, 630 or 730) carried by or defined in said fluidic circuit's distal wall, and the oscillating flow vortices spray from the discharge orifice as an oscillating spray of substantially uniform fluid droplets in a selected spray pattern having a selected spray width and a selected spray thickness.

In the method of the present invention, liquid product manufacturers making or assembling a transportable or disposable pressurized package for spraying or dispensing a liquid product, material or fluid would first obtain or fabricate the conformal fluidic cup circuit (e.g., 100, 400, 600 or 700) for incorporation into a nozzle assembly or aerosol spray head actuator body which typically includes the standard distally projecting sealing post (e.g., 320). The actuator body has a lumen for dispensing or spraying a pressurized liquid product or fluid from the disposable or transportable container to generate a spray of fluid droplets, and the conformal fluidic circuit includes the cup-shaped fluidic circuit member having a peripheral wall extending proximally and having a distal radial wall comprising an inner face with features defined therein and an open proximal end configured to receive the actuator's sealing post. The cup-shaped member's peripheral wall and distal radial wall have inner surfaces comprising a fluid channel including a chamber with a fluidic circuit oscillator inlet in fluid communication with an interaction region; and the cup shaped member's peripheral wall preferably has an exterior surface carrying a transversely projecting snap-in locking flange.

In the preferred embodiment of the assembly method, the product manufacturer or assembler next provides or obtains an actuator body (e.g., 340) with the distally projecting sealing post centered within a body segment having a snap-fit groove configured to resiliently receive and retain the cup shaped member's transversely projecting locking flange (e.g., 694 or 794). The next step is inserting the sealing post into the cup-shaped member's open distal end (e.g., 692 or 792) and engaging the transversely projecting locking flange into the actuator body's snap fit groove to enclose and seal the fluid channel with the chamber and the fluidic circuit oscillator inlet in fluid communication with the interaction region (e.g., 120, 620 or 720). A test spray can be performed to demonstrate that when pressurized fluid is introduced into the fluid channel, the pressurized fluid enters the chamber and interaction region and generates at least one oscillating flow vortex within the fluid channel's interaction region.

In the preferred embodiment of the assembly method, the fabricating step comprises molding the conformal fluidic circuit from a plastic material to provide a conformal, unitary, one-piece cup-shaped fluidic circuit member 700 having the distal radial wall inner face features or geometry 710 molded therein so that the cup-shaped member's inner surfaces provide an oscillation-inducing geometry which is molded directly into the cup's interior wall segments.

It will be appreciated that the conformal fluidic cup (e.g., 100, 400, 600 or 700) and method of the present invention readily conforms to the industry-standard actuator stem used in typical aerosol sprayers and trigger sprayers and so replaces the prior art "swirl cup" that goes over the actuator stem (e.g., 320}, and the benefits of using a fluidic oscillator (e.g., 100, 400, 600 or 700) are made available with little or no significant changes to other parts of the industry standard liquid product packaging. With the fluidic cup and method of the present invention, vendors of liquid products and fluids sold in commercial aerosol sprayers and trigger sprayers can now provide very specifically tailored or customized sprays.

The term "conformal" as used here, means that the fluidic oscillator is engineered to engage and "conform" to the exterior configuration of the dispensing package or applicator, where the conformal fluidic circuit {e.g., 100, 400, 600 or 700) has an "interior" and an "exterior" with a throat or discharge lumen (e.g., 130, 630 or 730) in fluid communication between the two, and where the conformal fluidic's interior surface carries or has defined therein a fluidic oscillator geometry (e.g., 110, 610 or 710) which operates on fluid passing therethrough to generate an oscillating spray of fluid droplets having a controlled, selected size, where the spray has a selected rectangular or 30 pattern.

Having described preferred embodiments of a new and improved lens cleaning system and method, it is believed that other modifications, variations and changes will be suggested to those skilled in the art in view of the teachings set forth herein. It is therefore to be understood that all such variations, modifications and changes are believed to fall within the scope of the appended claims which define the present invention.

We claim:

1. A conformal, unitary, one-piece fluidic circuit configured for easy and economical incorporation into a trigger spray nozzle assembly or aerosol spray head actuator body including distally projecting sealing post and a lumen for dispensing or spraying a pressurized liquid product or fluid from a transportable container to generate an exhaust flow in the form of an oscillating spray of fluid droplets, comprising;

(a) a cup-shaped fluidic circuit member having a peripheral wall extending proximally and having a distal radial wall comprising an inner face with features defined therein and an open proximal end configured to receive an actuator's sealing post;

(b) said cup-shaped member's peripheral wall and distal radial wall having inner surfaces comprising a fluid channel including a chamber when said cup-shaped member is fitted to body's sealing post;

(c) said chamber being configured to define a fluidic circuit oscillator inlet in fluid communication with an interaction region so when said cup-shaped member is fitted to body's sealing post and pressurized fluid is introduced via said actuator body, the pressurized fluid may enter said fluid channel's chamber and interaction region and generate at least one oscillating flow vortex within said fluid channel's interaction region;

(d) wherein said cup shaped member's distal wall includes a discharge orifice in fluid communication with said chamber's interaction region.

2. The conformal, unitary, one-piece fluidic circuit of claim 1, wherein said chamber is configured so that when said cup-shaped member is fitted to the body's sealing post and pressurized fluid is introduced via said actuator body, said chamber's fluidic oscillator inlet is in fluid communication with a first power nozzle and second power nozzle, wherein said first power nozzle is configured to accelerate the movement of passing pressurized fluid flowing through said first nozzle to form a first jet of fluid flowing into said chamber's interaction region, and said second power nozzle is configured to accelerate the movement of passing pressurized fluid flowing through said second nozzle to form a second jet of fluid flowing into said chamber's interaction region, and wherein said first and second jets impinge upon one another at a selected inter-jet impingement angle and generate oscillating flow vortices within said fluid channel's interaction region.

3. The conformal, unitary, one-piece fluidic circuit of claim 2, wherein said chamber is configured so that when said cup-shaped member is fitted to the body's sealing post and pressurized fluid is introduced via said actuator body, said chamber's interaction region is in fluid communication with said discharge orifice defined in said fluidic circuit's distal wall, and said oscillating flow vortices exhaust from said discharge orifice as an oscillating spray of substantially uniform fluid droplets in a selected spray pattern having a selected spray width and a selected spray thickness.

4. The conformal, unitary, one-piece fluidic circuit of claim 2, wherein said first and second power nozzles comprise venturi-shaped or tapered channels or grooves in said distal wall's inner face.

5. The conformal, unitary, one-piece fluidic circuit of claim 4, wherein said first and second power nozzles terminate in a rectangular or box-shaped interaction region defined in said distal wall's inner face.

6. The conformal, unitary, one-piece fluidic circuit of claim 4, wherein said first and second power nozzles terminate in a cylindrical interaction region defined in said distal wall's inner face.

7. The conformal, unitary, one-piece fluidic circuit of claim 4, wherein said selected inter-jet impingement angle is 180 degrees and said chamber is configured so that when said cup-shaped member is fitted to the body's sealing post and pressurized fluid is introduced via said actuator body, said oscillating flow vortices are generated within said fluid channel's interaction region by opposing jets.

8. The conformal, unitary, one-piece fluidic circuit of claim 1, wherein said cup-shaped fluidic circuit member is configured with a hand operated pump in a trigger sprayer configuration.

9. The conformal, unitary, one-piece fluidic circuit of claim 1, wherein said cup-shaped fluidic circuit member is configured with propellant pressurized aerosol container with a valve actuator.

10. A method for assembling a transportable or disposable package for spraying or dispensing a liquid product, material or fluid from a nozzle assembly or spray head actuator, comprising:

(a) fabricating a conformal fluidic circuit configured for easy and economical incorporation into a nozzle assembly or aerosol spray head actuator body including distally projecting sealing post and a lumen for dispensing or spraying a pressurized liquid product or fluid from a transportable container to generate an exhaust flow in the form of an oscillating spray of fluid droplets, said conformal fluidic circuit including a cup-shaped fluidic circuit member having a peripheral wall extending proximally and having a distal radial wall comprising an inner face with features defined therein and an open proximal end configured to receive an actuator's sealing post; said cup-shaped member's peripheral wall and distal radial wall having inner surfaces comprising a fluid channel including a chamber with a fluidic circuit oscillator inlet in fluid communication with an interaction region; said cup shaped member's peripheral wall having an exterior surface carrying a transversely projecting locking flange.

11. The assembly method of claim 10, further comprising:

(b) providing an actuator with a body having a distally projecting sealing post and a snap-fit groove configured to resiliently receive and retain said cup shaped member's transversely projecting locking flange;

(c) inserting said sealing post into said cup-shaped member's open distal end and engaging said transversely projecting locking flange into said actuator body's snap fit groove to define said fluid channel with said chamber and said fluidic circuit oscillator inlet in fluid communication with the interaction region, so that when pressurized fluid is introduced into said fluid channel, the pressurized fluid may enter said chamber and interaction region and generate at least one oscillating flow vortex within said fluid channel's interaction region.

12. The assembly method of claim 10, wherein fabricating step (a) comprises molding said conformal fluidic circuit from a plastic material to provide a conformal, unitary, one-piece cup-shaped fluidic circuit member having the distal radial wall inner face features molded therein and wherein said cup-shaped member's inner surfaces comprise an oscillation-inducing geometry which is molded directly into the cup's interior wall segments.

13. The assembly method of claim 10, further comprising:

(b) providing an actuator configured with a hand operated pump in a trigger sprayer configuration with a body having a distally projecting sealing post and a snap-fit groove configured to resiliently receive and retain said cup shaped member's transversely projecting locking flange;

(c) inserting said sealing post into said cup-shaped member's open distal end and engaging said transversely projecting locking flange into said actuator body's snap fit groove to define said fluid channel with said chamber and said fluidic circuit oscillator inlet in fluid communication with the interaction region, so that when pressurized fluid is introduced into said fluid channel, the pressurized fluid may enter said chamber and interaction region and generate at least one oscillating flow vortex within said fluid channel's interaction region.

14. The assembly method of claim 10, further comprising:

(b) providing an actuator configured with propellant pressurized aerosol container with a valve actuator having a body with a distally projecting sealing post and a snap-fit groove configured to resiliently receive and retain said cup shaped member's transversely projecting locking flange;

(c) inserting said sealing post into said cup-shaped member's open distal end and engaging said transversely projecting locking flange into said actuator body's snap fit groove to define said fluid channel with said chamber and said fluidic circuit oscillator inlet in fluid communication with the interaction region, so that when pressurized fluid is introduced into said fluid channel, the pressurized fluid may enter said chamber and interaction region and generate at least one oscillating flow vortex within said fluid channel's interaction region.

* * * * *